US007416228B2

(12) United States Patent
Pfitzinger et al.

(10) Patent No.: US 7,416,228 B2
(45) Date of Patent: Aug. 26, 2008

(54) CONTAINER WITH ADJUSTABLE ROTARY LOCK

(75) Inventors: Kurt Pfitzinger, Jonesboro, AR (US); Bryan Anderson, Jonesboro, AR (US); Kelly Jones, Elkins, AR (US); Ron Eberwein, Jonesboro, AR (US); Randy Key, Jonesboro, AR (US)

(73) Assignee: Delta Consolidated Industries, Raleigh, NC (US)

( * ) Notice: Subject to any disclaimer, the term of this patent is extended or adjusted under 35 U.S.C. 154(b) by 183 days.

(21) Appl. No.: 10/798,928

(22) Filed: Mar. 11, 2004

(65) Prior Publication Data

US 2005/0052033 A1 Mar. 10, 2005

Related U.S. Application Data

(60) Provisional application No. 60/501,212, filed on Sep. 8, 2003.

(51) Int. Cl.
*E05C 3/06* (2006.01)
*E05C 3/16* (2006.01)

(52) U.S. Cl. ..... 292/216; 292/341.18; 292/214; 292/DIG. 24

(58) Field of Classification Search ..... 292/216, 292/213, 215, 54, 341.18, 341.19, 50, 28, 292/DIG. 37; 220/324, 326
See application file for complete search history.

(56) References Cited

U.S. PATENT DOCUMENTS 1,036,347 A * 8/1912 Schmittberger ..... 292/116
1,323,007 A * 11/1919 Brunette ..... 160/290.1
2,224,512 A * 12/1940 Endter ..... 292/214
2,374,840 A * 5/1945 Schonitzer ..... 292/2
2,788,997 A * 4/1957 Wagner et al. ..... 292/341.17
3,010,750 A * 11/1961 Cockburn ..... 292/279
3,045,276 A * 7/1962 Schwarz ..... 16/79
3,699,608 A * 10/1972 Schwarz ..... 16/79
3,909,060 A * 9/1975 Katayama ..... 296/37.16
4,298,223 A * 11/1981 Raffelsiefer et al. ..... 292/216
4,432,575 A * 2/1984 Garvey et al. ..... 292/341.18
4,691,952 A * 9/1987 Harmon ..... 292/341.18
4,706,333 A * 11/1987 Lauderbach ..... 16/289
4,826,224 A * 5/1989 Lee ..... 292/254
4,927,196 A * 5/1990 Girard et al. ..... 292/201
5,496,080 A * 3/1996 Chabanne et al. ..... 292/252
5,722,706 A * 3/1998 Bartel et al. ..... 292/216
5,821,488 A * 10/1998 Falcon ..... 200/52 R

OTHER PUBLICATIONS

Drawings for Console Assembly Jan. 16, 2002, #38700-04.

* cited by examiner

*Primary Examiner*—Patricia Engle
*Assistant Examiner*—Mark Williams
(74) *Attorney, Agent, or Firm*—Myers Bigel Sibley & Sajovec

(57) ABSTRACT

A rotary unit for use with a locking system includes: a base plate having a slot; a rotary member rotatably mounted with the base plate about a first axis of rotation, the rotary member including a plurality of fingers extending radially outwardly from a central portion thereof and an engagement portion fixed to the central portion; and a pawl member pivotally mounted with the base plate about a second axis of rotation and coupled with the connecting member. The pawl member includes an engagement projection that selectively engages the engagement portion of the rotary member to prevent rotation of the rotary member in a first rotative direction but permits rotation of the rotary member in a second rotative direction that is opposite the first rotative direction.

30 Claims, 13 Drawing Sheets

CONTAINER WITH ADJUSTABLE ROTARY LOCK

RELATED APPLICATION

This application claims priority from U.S. Provisional Patent Application No. 60/501,212, filed 8 Sep. 2003, entitled "Container with Adjustable Rotary Lock."

FIELD OF THE INVENTION

The present invention is directed generally to containers, and more specifically to containers with integrated locking systems.

BACKGROUND OF THE INVENTION

A truck box is a container that is mounted in the bed of a truck, typically a pick-up truck. Ordinarily, the truck box is mounted directly behind the cab of the truck and spans the distance between the side walls of the truck bed. Items like tools, fasteners, and the like can be stored in the truck box rather than simply laying loose in the truck bed.

A typical truck box has a rectangular receptacle and a lid that opens to permit access to the interior of the truck box. Many truck boxes have lateral portions, termed "tray pockets," that overlie the walls of the truck bed to provide additional storage space. In some instances a biasing device, such as a spring or gas cylinder, is mounted within the interior of one or both tray pockets to facilitate opening of the lid.

As the lid of a truck box should remain closed while driving or when the truck is not in use, it is often desirable that the truck box include a locking system that secures the lid in a closed position. One such locking system is included with truck boxes sold under the trade name JOBOX® by Delta Consolidated Industries, Inc. (Jonesboro, Ark.). This locking system has two palm buttons located in the side walls of the box ends. Actuation of either of the palm buttons releases an internal lock and, assisted by gas cylinders located in the tray pockets, raises the lid to an open position. The internal lock includes an engagement member that is pivotally attached to a base bracket and a pawl member that is coupled to the push buttons with a connecting rod. The engagement member includes a slot that receives a striker pin attached to the lid and is spring-biased to a position in which it releases the pin. The pawl member is spring-biased to engage either of two recesses in the engagement member to prevent it from moving to the release position. Thus, when the lid is closed, the pawl member maintains the engagement member in a position to engage the pin. Actuation of the palm button disengages the pawl member such that the engagement member is urged by its spring to pivot sufficiently to release the pin. The lid is urged by the gas cylinder to move to a raised position. Closing the lid causes re-engagement of the pawl member and engagement member to retain the lid in place. In many truck boxes, two internal locks are included, and they are coupled such that both release when either of the palm buttons is actuated.

Although this type of lock has proven to be popular, there are some shortcomings. For example, positioning of the pin and engagement member are important, and slight misalignment, either horizontally or vertically, can prevent the lid from closing securely. This can be problematic due to varying manufacturing tolerances (typically a truck box is the full width of a pick-up truck bed, so a slight mismatch of components can become greatly exaggerated over the full length of the truck box), or if the lid becomes slightly misshapen due to abuse, racking, or the like. Also, the use of springs for both the engagement member and the pawl member can reduce consistency of operation, particularly when two internal lock units are used and the pins engage the engagement member at slightly different times.

SUMMARY OF THE INVENTION

The present invention can address some of the performance issues raised by prior art containers. As a first aspect, embodiments of the present invention are directed to a container comprising: a receptacle having walls, a floor, and an open end; a cover pivotally attached to one of the walls of the receptacle, the cover being movable between an open position, in which the open end of the receptacle can be accessed, and a closed position, in which the cover overlies the open end of the receptacle; a locking pin mounted on the cover or a receptacle wall; and at least one locking system for maintaining the cover in the closed position. The locking system comprises: a release member attached to either the cover or one of the receptacle walls; a connecting member attached to the release member; and a rotary unit. The rotary unit includes a base plate having a slot, a rotary member rotatably mounted with the base plate about a first axis of rotation, the rotary member including a plurality of fingers extending radially outwardly from a central portion thereof and an engagement portion fixed to the central portion, and a pawl member pivotally mounted with the base plate about a second axis of rotation and coupled with the connecting member. When the cover is in the closed position, the locking pin is received within the slot of the rotary unit base plate and engages one of the fingers of the rotary member, and the pawl member engages the engagement portion to prevent rotation thereof. Actuation of the release member disengages the pawl member from the engagement portion, thereby enabling the rotary member to rotate freely relative to the base plate, which rotation disengages the locking pin from the rotary member and enables the cover to move to the open position. With this configuration, the locking system can accommodate containers in which the cover is somewhat misaligned with the receptacle.

As a second aspect, embodiments of the present invention are directed to a rotary unit for use with a locking system. The rotary unit comprises: a base plate having a slot; a rotary member rotatably mounted with the base plate about a first axis of rotation, the rotary member including a plurality of fingers extending radially outwardly from a central portion thereof and an engagement portion fixed to the central portion; and a pawl member pivotally mounted with the base plate about a second axis of rotation and coupled with the connecting member. The pawl member includes an engagement projection that selectively engages the engagement portion of the rotary member to prevent rotation of the rotary member in a first rotative direction but permits free rotation of the rotary member in a second rotative direction that is opposite the first rotative direction.

As a third aspect, embodiments of the present invention are directed to a container comprising: a receptacle having walls, a floor, and an open end; a cover pivotally attached to one of the side walls of the receptacle, the cover being movable between an open position, in which the open end of the receptacle can be accessed, and a closed position, in which the cover overlies the open end of the receptacle; a locking pin assembly fixed to the cover or one of the receptacle walls; and at least one locking system for maintaining the cover in the closed position. The locking pin assembly comprises: a mounting bracket fixed to the cover or one of the receptacle walls; a striker plate mounted to the mounting bracket and movable relative thereto; and a locking pin attached to the striker plate. The locking system comprises: a release member attached to one of the receptacle side walls; a connecting member attached to the release member; and a rotary unit including a base plate having a slot, a rotary member rotatably mounted with the base plate about a first axis of rotation, the rotary member including at least two fingers and an engagement portion, and a pawl member pivotally mounted with the base plate about a second axis of rotation and coupled with the connecting member. When the cover is in the closed position, the locking pin is received within the slot of the rotary unit base plate and engages one of the fingers of the rotary member, and the pawl member engages the engagement portion to prevent rotation thereof. Actuation of the release member disengages the pawl member from the engagement portion, thereby enabling the rotary member to rotate relative to the base plate, which rotation disengages the locking pin from the rotary member and enables the cover to move to the open position. This configuration can enable the position of the locking pin to shift relative to the slot in order to accommodate slightly misaligned cover and receptacle components.

As a fourth aspect, embodiments of the present invention are directed to a container, comprising: a receptacle having side walls, a floor, and an open end; a cover pivotally attached to one of the side walls of the receptacle, the cover being movable between an open position, in which the open end of the receptacle can be accessed, and a closed position, in which the cover overlies the open end of the receptacle; a locking pin assembly fixed to the cover; and at least one rotary unit. The locking pin assembly comprises: a mounting bracket fixed to the cover, the mounting bracket having an oblong aperture; a slide plate residing within the aperture and slidable relative thereto, the slide plate including an opening; and a locking pin inserted in the slide plate opening. The locking system comprises: a release member attached to one of the receptacle side walls; a connecting member attached to the release member; and a rotary unit including a base plate having a slot, a rotary member rotatably mounted with the base plate about a first axis of rotation, the rotary member including at least two fingers and an engagement portion, and a pawl member pivotally mounted with the base plate about a second axis of rotation and coupled with the connecting member. When the cover is in the closed position, the locking pin is received within the slot of the rotary unit base plate and engages one of the fingers of the rotary member, and the pawl member engages the engagement portion to prevent rotation thereof. Actuation of the release member disengages the pawl member from the engagement portion, thereby enabling the rotary member to rotate relative to the base plate, which rotation disengages the locking pin from the rotary member. The configuration of the locking pin assembly can also assist in locking the container when the cover and receptacle are somewhat misaligned.

DETAILED DESCRIPTION OF EMBODIMENTS OF THE INVENTION

Figure 1:
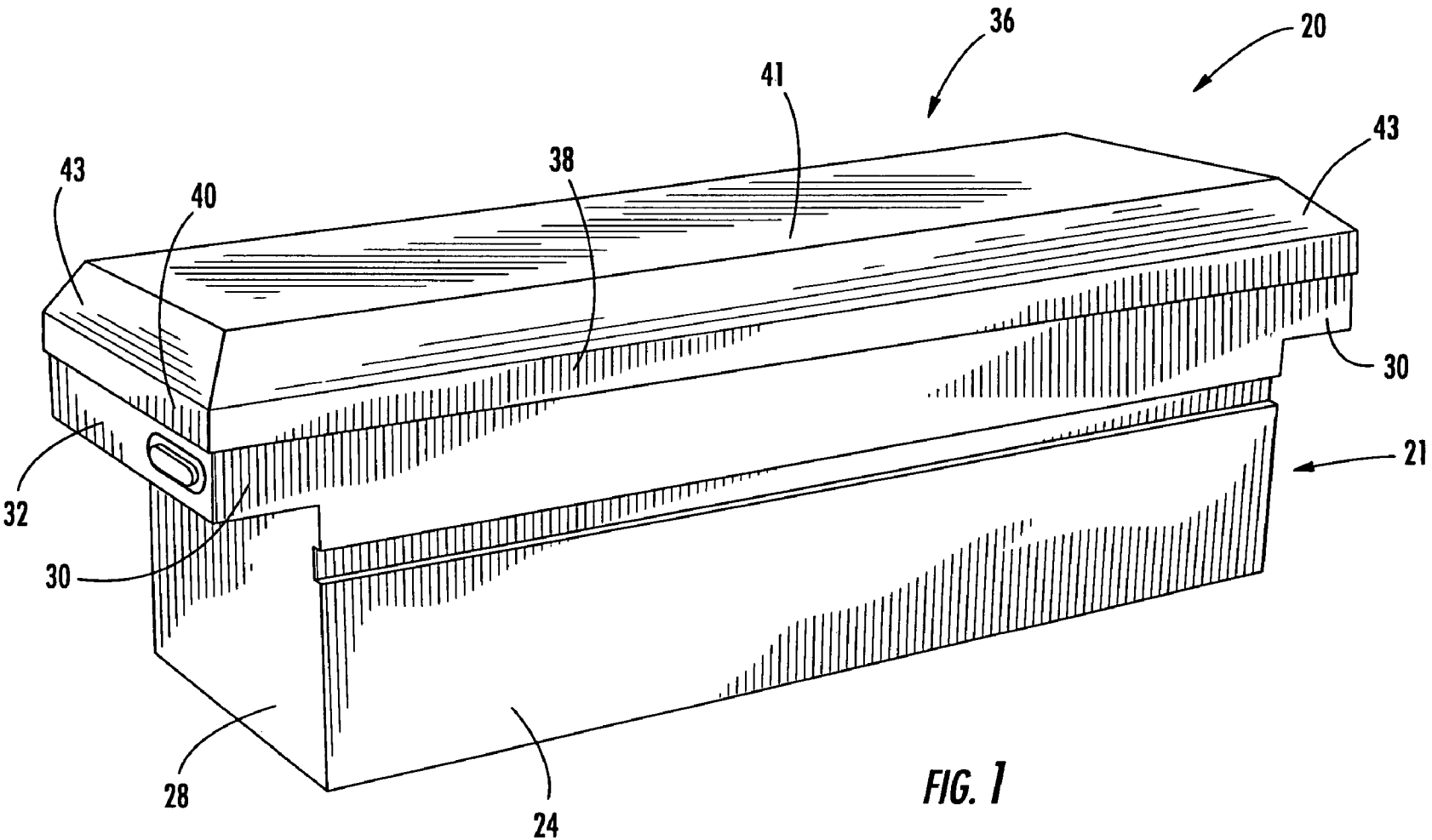
FIG. 1 is a perspective view of a container according to embodiments of the present invention, wherein the container is shown in the closed position.

The present invention will now be described more fully hereinafter, in which preferred embodiments of the invention are shown. This invention may, however, be embodied in different forms and should not be construed as limited to the embodiments set forth herein. Rather, these embodiments are provided so that this disclosure will be thorough and complete, and will fully convey the scope of the invention to those skilled in the art. In the drawings, like numbers refer to like elements throughout. Thicknesses and dimensions of some components may be exaggerated for clarity. It will be understood that when an element is referred to as being "attached", "connected" or "coupled" to another element, it can be directly connected or coupled to the other element or intervening elements may be present. In contrast, when an element is referred to as being "directly connected" or "directly coupled" to another element, there are no intervening elements present.

Figure 2:
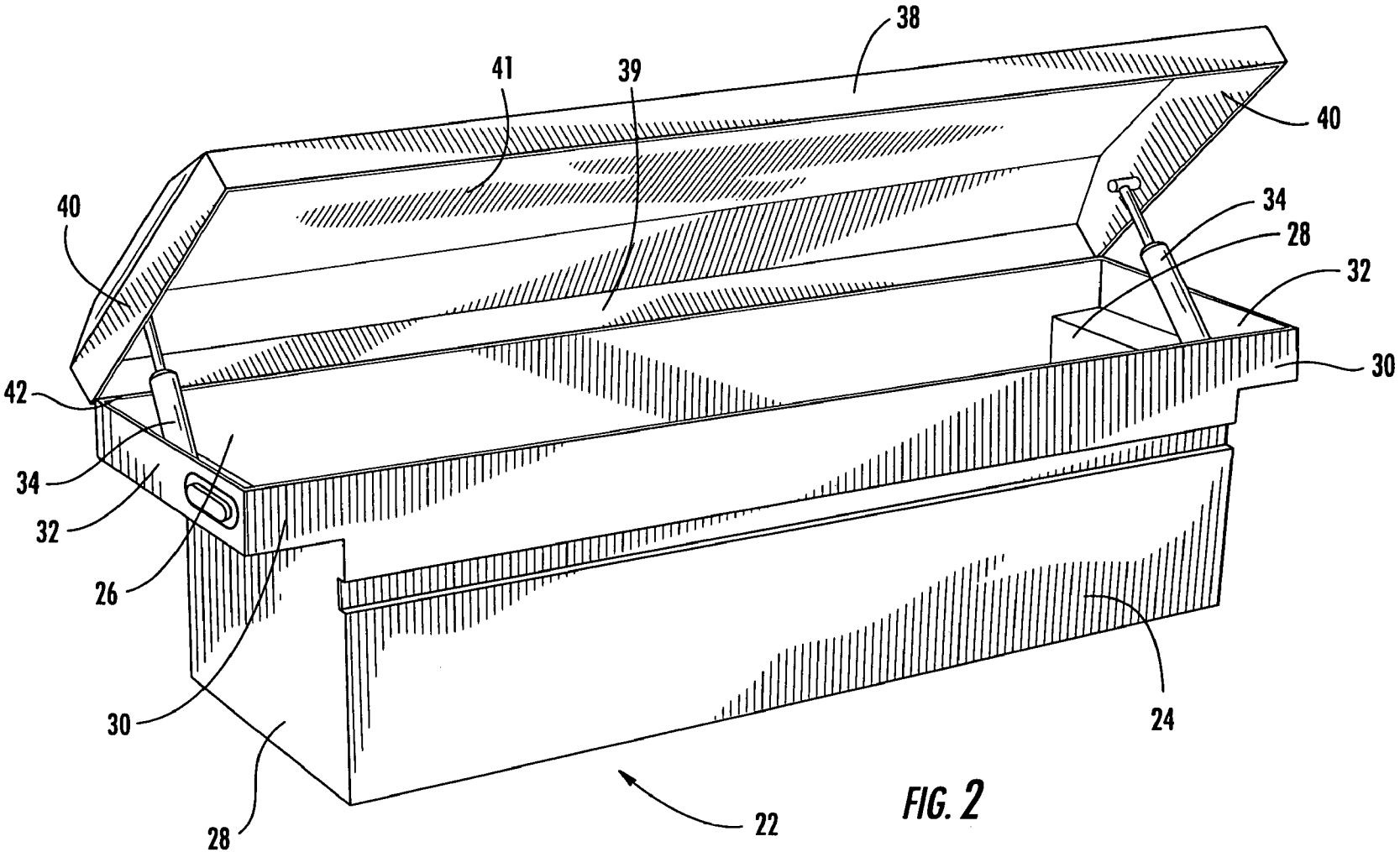
FIG. 2 is a perspective view of the container of FIG. 1 in the open position.

Referring now to the figures, a truck box, designated broadly at 20, is illustrated in FIGS. 1 and 2. The truck box 20 includes a receptacle 21 and a cover 36 pivotally attached thereto via a hinge 42. The receptacle 21 includes a floor 22, a front wall 24, a rear wall 26, and two opposing side walls 28, all of which merge at their edges to form an open-ended rectangular box. Winged portions 30 extend laterally from the upper portions of the side walls 28. As used herein, the terms "forward", "front" and derivatives thereof refer to the direction defined by a vector extending from the rear wall 26 of the truck box 20 toward the front wall 24 parallel to the floor 22. Conversely, the terms "rearward" and derivatives thereof refer to the direction directly opposite the forward direction; i.e., the rearward direction is defined by a vector that extends from the front wall 24 toward the rear wall 26 parallel to the floor 22. The forward and rearward directions together comprise the "longitudinal" directions relative to the truck box. The term "outward", "lateral" and derivatives thereof refer to the direction defined by a vector originating in the center of the truck box 20 and extending in the plane of the floor 22 and perpendicular to the forward and rearward directions. The terms "inboard", "inward" and derivatives thereof refer to the direction directly opposite to the lateral direction as defined hereinabove. The outward and inward directions together comprise the "transverse" directions relative to the truck box 20.

The cover 36 includes a front wall 38, a rear wall 39, side walls 40, and a ceiling 41. Beveled transition panels 43 extend between the walls 38, 39, 40 and ceiling 41. The lower edge of the rear wall 39 is attached to the hinge 42, which is also attached to the upper edge of the receptacle rear wall 26. The presence of the hinge 42 enables the cover 36 to pivot about a transversely-extending pivot axis A1 defined by the hinge 42. Pivoting of the cover 36 allows the cover 36 to move between an open position, in which the open end of the receptacle 21 can be accessed, and a closed position, in which the cover 36 overlies the open end of the receptacle 21. Movement of the cover 36 to the open position is augmented by two gas cylinders 34 that are mounted to the rear wall 26 via mounting brackets 29 and to the ceiling 41 of the cover 36; the gas cylinders 34 bias the cover 36 toward the open position to assist in opening the cover 36 and to reduce the tendency of the cover 36 to slam shut under its own weight. The winger portions 30 support storage trays 31.

Those skilled in this art will recognize that the receptacle 21 and cover 36 may take other configurations. For example, the winged portions 30 may be omitted, or the receptacle 21 may be square or oblong rather than rectangular. Also, the present invention may be employed with containers other than truck boxes, and the receptacle 21 may even be oriented vertically, such that the open end thereof faces forwardly rather than upwardly, and such that the closed cover forms the front of the box rather than the top. Those skilled in this art will recognize other appropriate container forms for the present invention.

Figure 3:
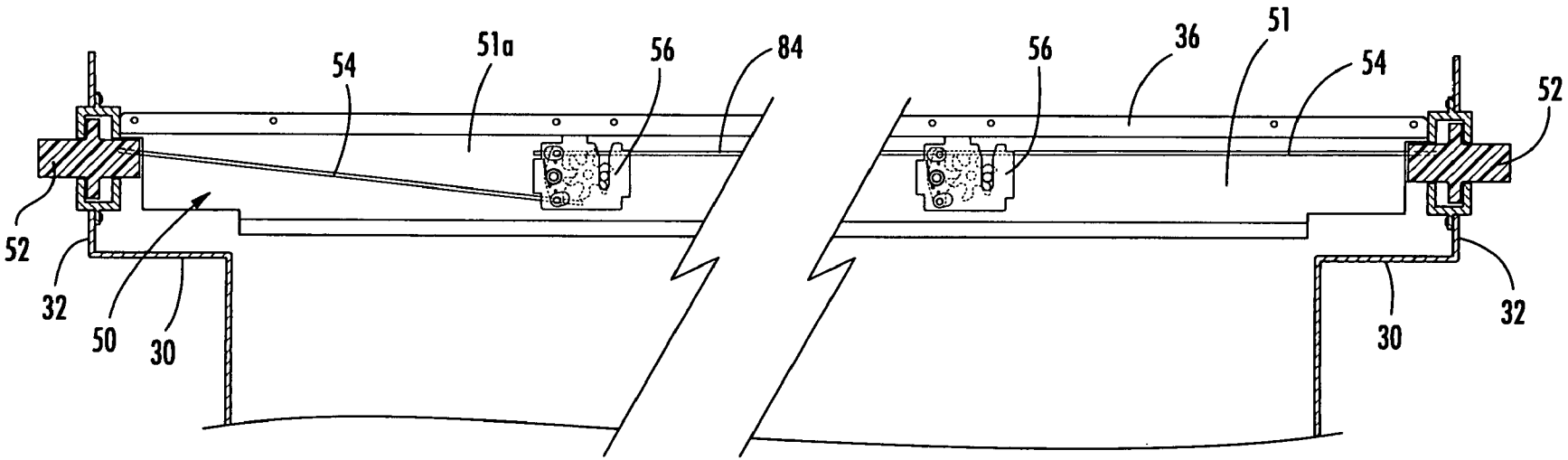
FIG. 3 is a broken section view of the container of FIG. 1 showing the locking system thereof.
Figure 3A:
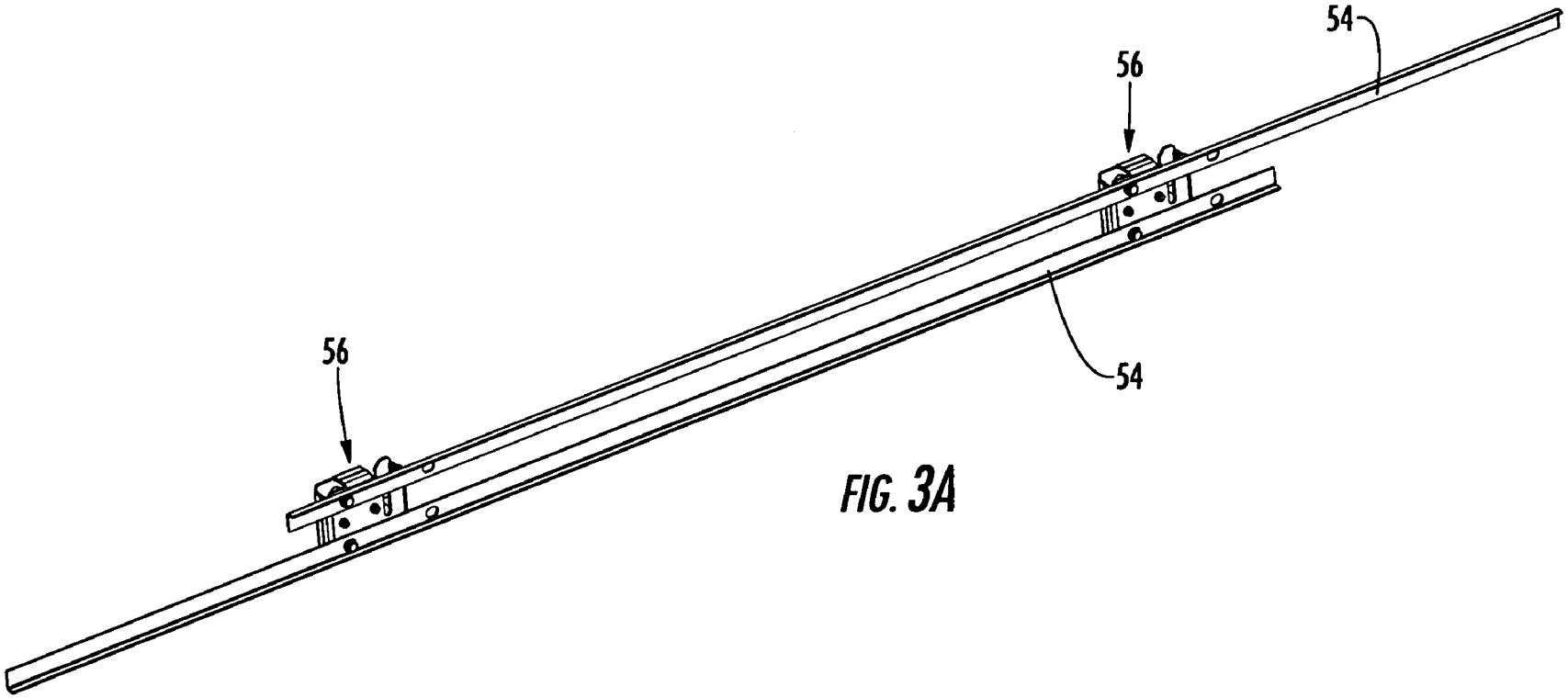
FIG. 3A is a rear perspective view of the locking system of FIG. 3 with the locking console removed.

Referring now to FIGS. 3 and 3A, a locking system 50 is mounted to the receptacle 21 via a lock console 51, which comprises a generally C-shaped channel that is mounted to and extends transversely behind an upper portion of the front wall 24. The locking system 50 includes two palm buttons 52 mounted on respective wing walls 32, two rotary units 56 mounted to the front surface of the lock console 51, and two connecting rods 54, each of which connects a palm button 52 with two rotary units 56. These components are described in greater detail below.

Referring again to FIGS. 3 and 3A, the palm buttons 52 can be any type of release member known to those skilled in this art. The connecting rods 54, which may be simple metal dowels or members that take a different form, such as a rigid strip, elongate angled member, or the like, are positioned near the palm buttons 52 such that actuation of the palm button 52 (i.e., through the application of an inwardly-directed force) moves the connecting rod 54 inwardly away from the side wall 28 of the receptacle 21 and toward the rotary unit 56. As described below, such movement induces the rotary unit 56 to release a locking pin 102 (also known as a "striker") that is mounted on the cover 36, thereby enabling the cover 36 to move to the open position of FIG. 2.

The rotary units 56 are, illustratively and preferably, identical to one another, but are connected slightly differently to the connecting rods 54. Because they are identical, only one rotary unit 56 will be described in detail below; those skilled in this art will appreciate that this discussion is equally applicable to the other rotary unit 56 also. Moreover, it should be understood that the truck box 20 may also be constructed with rotary units that are not identical.

Figure 4:
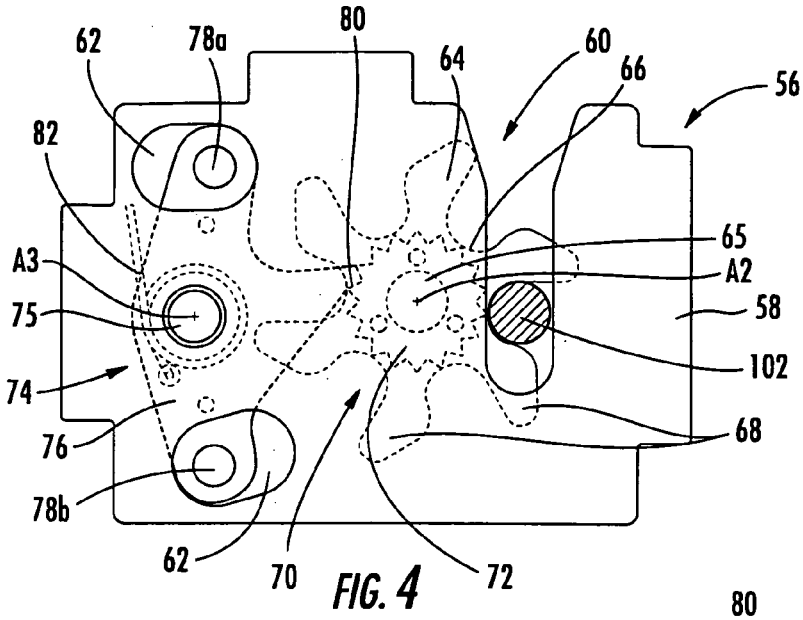
FIG. 4 is a greatly enlarged front view of the rotary unit of the locking system of FIG. 3 with the locking pin captured by the rotary member.
Figure 4A:
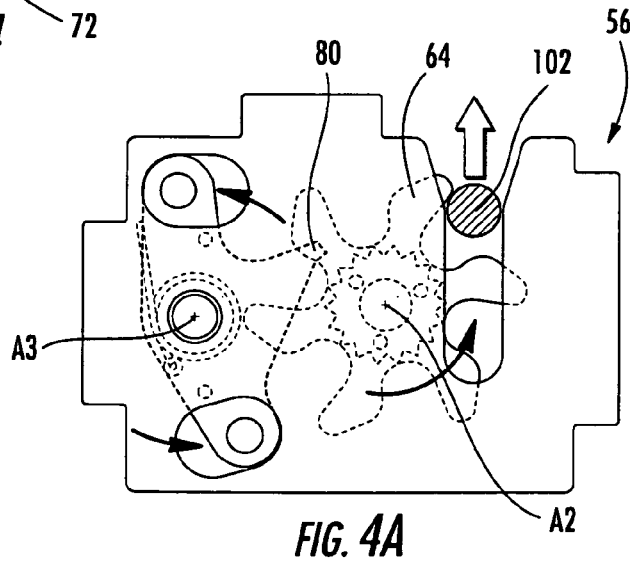
FIG. 4A is a greatly enlarged front view of the rotary unit of FIG. 4 showing the release of the locking pin by the rotary member.

Referring now to FIGS. 4 and 4A, the rotary unit 56 includes two base plates 58 (only one of which is shown herein), a rotary member 64, and a pawl member 74. The base plates 58 serve to provide mounting locations for the other components of the rotary unit 56. One of the base plates 58 is mounted to a rear wall 51*a* of the lock console 51, and the other base plate 58 is positioned forwardly of and fixed relative to the first base plate 58 such that the other components of the rotary unit 56 are sandwiched therebetween. Each base plate 58 includes a slot 60 that opens upwardly to the upper edge of the base plate 58. Also, the forwardmost base plate 58 includes a pair of pawl post apertures 62*a*, 62*b* that are positioned in general vertical alignment.

Referring still to FIGS. 4 and 4A, the rotary member 64 includes a central portion 65 from which a plurality of substantially identical fingers 68 (in the illustrated embodiment, six fingers 68 are shown, although other numbers of fingers, such as four or five, may also be used) extend radially outwardly and are spaced substantially circumferentially equidistant from one another. The fingers 68 are slightly lobed, first increasing, then decreasing in width as they extend outwardly from the central portion 65. Gaps 70 are created between adjacent fingers 68, the gaps 70 being sized to receive the locking pin 102. The central portion 65 of the rotary member 64 is pivotally attached to the base plate 58 at a pivot 66 that defines a pivot axis A2. The rotary member 64 also includes an engagement gear 72 that is fixed to the central portion 65. The engagement gear 72 includes eighteen teeth 73 about its circumference, although any number of teeth may be included.

In some embodiments, the rotary member 64 can be formed of multiple layers of material (preferably steel), each of which is perpendicularly disposed to the axis A2. In this configuration, the strength of the rotary member 64 (and the locking system overall) can be varied by simply including different numbers of layers in the rotary member 64. Layering in this manner can enable a manufacturer to produce different lock strengths with the components of the same design.

Referring again to FIGS. 4 and 4A, the pawl member 74 of the rotary unit 56 includes a body 76, the central portion of which is pivotally attached to the base plate 58 at a pivot 75 that defines a pivot axis A3. Pawl posts 78*a*, 78*b* are mounted at either end of the body 76 and extend through respective pawl post apertures 62*a*, 62*b*. The pawl member 74 also includes an engagement projection 80 that extends from the body 76 toward the rotary member 64. The engagement projection 80 is sized and configured to engage the teeth 73 of the engagement gear 72. A helical spring 82 is mounted to one of the base plates 58 and to the pawl member 74 to bias it to pivot toward engagement with the engagement gear 72 (i.e., toward the position shown in FIG. 4).

One of the pawl posts 78*a*, 78*b* of each rotary unit 56 is coupled with a respective connecting rod 54. Referring to FIG. 3, the rotary unit 56 illustrated therein on the left side of the truck box 20 is coupled to the lower connecting rod 54 with its lower pawl post 78*a*, while the upper pawl post 78*b* is coupled to the upper connecting rod 54. For the rotary unit 56 shown on the right in FIG. 3, the upper pawl post 78*b* is coupled to the upper connecting rod 54, and the lower pawl post 78*a* is coupled to the lower connecting rod 54.

Figure 6:
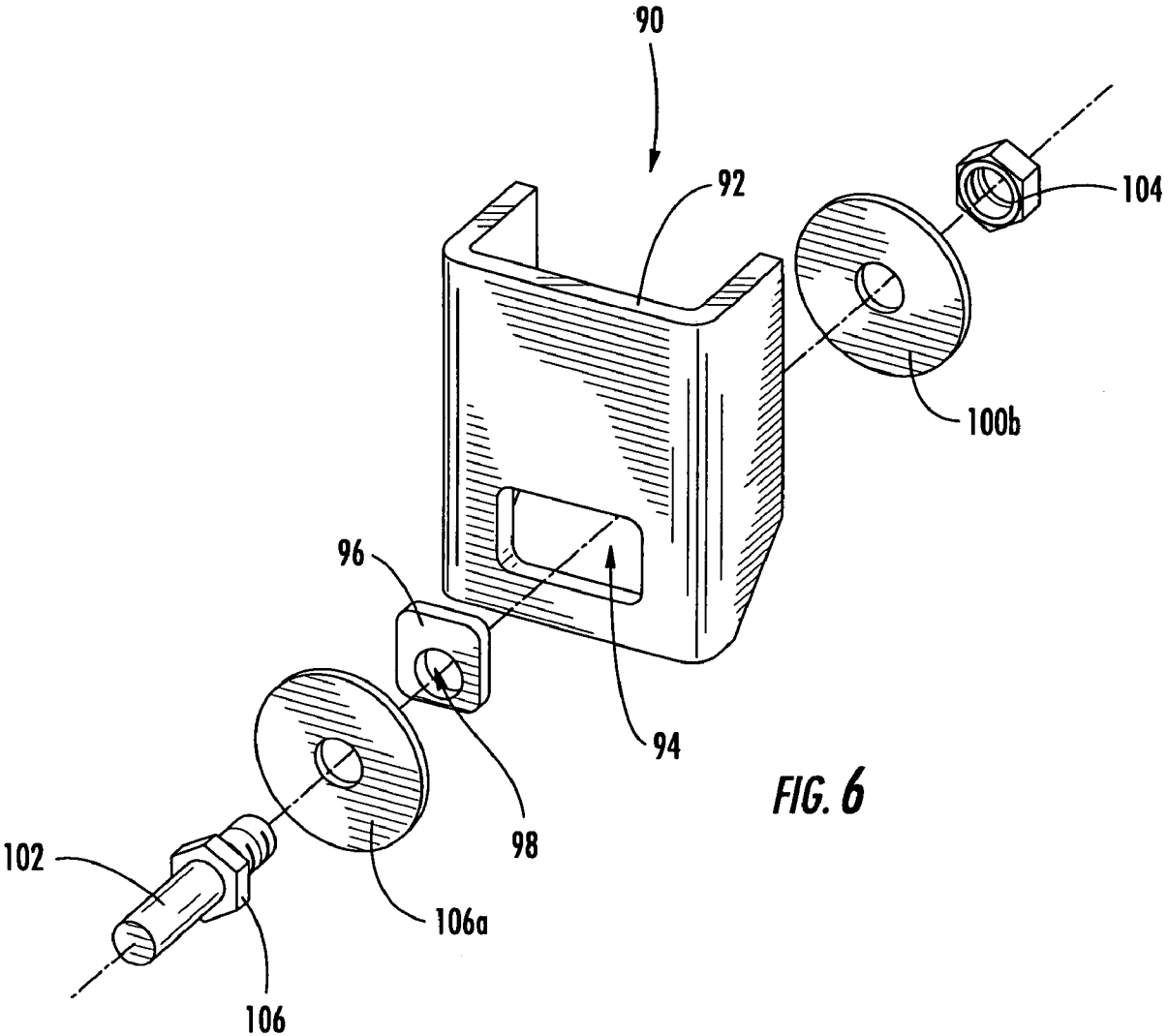
FIG. 6 is an exploded perspective view of the locking pin assembly of the locking system of the container of FIG. 1.

Referring now to FIG. 6, a locking pin assembly 90 is mounted to the ceiling 41 of the cover 36 via a mounting bracket 92 that depends downwardly therefrom. The mounting bracket 92 includes a generally rectangular aperture 94. A generally square slide member 96 resides within the aperture 94; the slide member 96 is sized such that, when it is positioned in the aperture 94, the height of the slide member 96 is approximately equal to that of the aperture 94, and its width is narrower than that of the aperture 94, thereby allowing the slide member 96 to slide within the aperture 94. An opening 98 is positioned eccentrically from the center of the slide member 98. The slide member 96 is retained in the aperture 94 by two washers 100. The locking pin 102 extends through the washers 100 and the opening 98 in the slide member 96. One end of the locking pin 102 is threaded and received in a nut 104 that abuts one of the washers 100. The other end of the locking pin 102 extends away from a collar 106 that abuts the other washer 100 and is positioned to be received in the slot 60 of the rotary unit 56 when the cover 36 is in the closed position.

Figure 7:
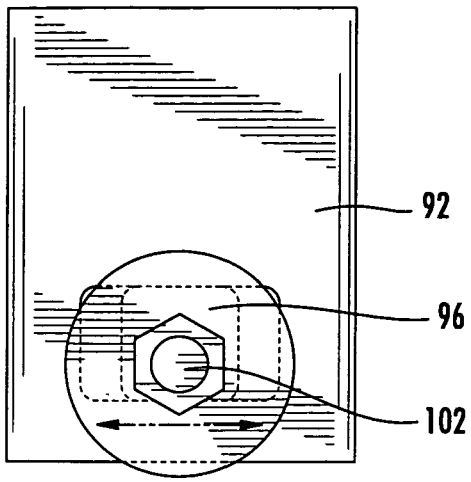
FIGS. 7-9 are front views of the locking pin assembly of FIG. 6 with the locking pin shown in different secured positions.
Figure 8:
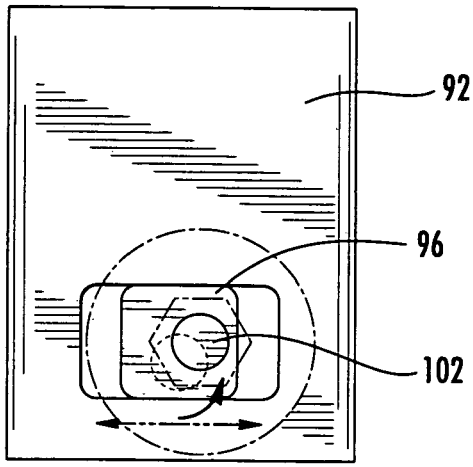
Figure 9:
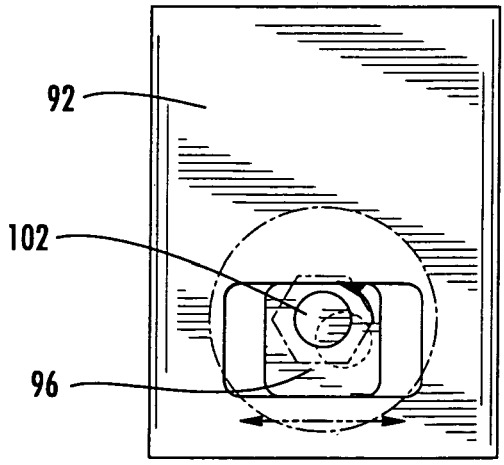

As is illustrated in FIGS. 7-9, the position of the locking pin 102 relative to the mounting bracket 92 (and, in turn, to the cover 36) can be adjusted by movement or re-orientation of the slide member 96 within the aperture 94 both parallel and perpendicular to the slot 60. As illustrated in FIGS. 7-9, the aperture 94 is wider than the slide member 96, which enables the slide member 96 and locking post 102 to be repositioned laterally within the aperture 94 and secured in a new position. Also, the substantially square shape of the slide member 96 enables it to be re-oriented at 90 degree increments within the aperture 94 (see, in sequence, FIGS. 7 through 9, which show the slide member 96 oriented in three different positions). Because the opening 98 of the slide member 96 is offset from the center of the slide member 96, re-orientation of the slide member 96 within the aperture 94 changes the elevation of the opening 98 and, in turn, the locking pin 102. Thus, the locking pin 102 can be positioned in any number of locations relative to the cover 36 depending on which aligns it most desirably with its corresponding rotary unit 56.

Those skilled in this art will appreciate that, in some embodiments, the locking pin 102 may be non-adjustable relative to the cover 36. Also, in some embodiments the locking pin 102 may be mounted to a different portion of the cover 36. Further, in other embodiments the locking pin assembly 90 may be attached to the receptacle 21 and the locking system 50 attached to the cover 36.

Opening of the truck box 20 can be understood by reference to FIGS. 1-4A. In the closed position shown in FIG. 1, the cover 36 overlies the receptacle 21. As shown in FIGS. 3 and 4, the palm buttons 52 are extended outwardly, and the pawl members 74 are pivoted such that each respective pawl post that is coupled to a connecting rod 54 (pawl post 78*a* for the rotary unit 56 on the left in FIG. 3, and pawl post 78*b* for the rotary unit 56 on the right in FIG. 3) is positioned in its pawl post aperture 62 to its outwardmost position. The pawl members 74 are urged toward this position by the springs 82, which bias the pawl members 74 to pivot about the axis A3 in a clockwise direction from the vantage point of FIGS. 3 and 4. With the pawl members 74 in this position, the engagement projection 80 of each engages the teeth 73 of the engagement gear 12. The geometry of the pivots 65, 75 and the shapes of the teeth 73 and the engagement projection 80 prevents the rotary member 64 from rotating counterclockwise about the axis A2. The locking pin 102 is positioned within the slot 60 in the base plates 58 and is captured in a gap 70 between two fingers 68. Capture of the locking pin 102 prevents the cover 36 from opening.

Referring now to FIG. 4A, actuation of one of the palm buttons 52 forces the corresponding connecting rod 54 inwardly. This action drives the pawl post 78*a*, 78*b* attached to its corresponding connecting rod 54 inwardly, which in turn forces the pawl member 74 to rotate about the axis A3. Pivoting of the pawl member 74 disengages the engagement projection 80 from the engagement gear 72, thereby permitting the rotary member 64 to rotate freely about the axis A2. Because the cover 36 is biased by the gas cylinders 34 toward the open position, free rotation of the rotary members 64 allows the locking projections 102 (which are fixed relative to the cover 36) to slide upwardly out of the slots 60 (see FIG. 4A), which in turn allows the cover 36 to rise into its open position (see FIG. 2) to allow access to the receptacle 21. The rotary members 64 rotate counterclockwise (see FIG. 4A) as the locking pin 102 rises from the slot 60.

The cover 36 is returned to the closed position of FIG. 1 by applying a downwardly-directed force thereto sufficient to overcome the biasing force of the gas cylinders 34. As the locking pin 102 enters and descends in the slot 60, it contacts one of the fingers 68, which in turn rotates the rotary member 64 (in a clockwise direction from the vantage point of FIG. 4). The rotary member 64 is prevented from rotating in the opposite direction (i.e., counterclockwise from the vantage point of FIG. 4) by the interaction between the engagement gear 72 and the engagement projection 80 of the pawl member 74, as the pawl member 74 is biased by the spring 82 to engage the engagement gear 72. The locking pin 102 continues to descend in the slot 60 until the cover 36 is completely closed.

Notably, as the cover 36 is moved to the closed position, the interaction between the teeth 73 of the engagement gear 72 and the engagement projection 80 of the pawl member 74 enables the locking system to lock the locking pin 102 in several different positions within the slot 60. As a result, the locking system 50 can adapt to situations in which the cover 36 becomes misshapen or its manufacturing tolerances cause some misalignment. This can be particularly important in instances in which one locking pin 102 enters its slot 60 before the second locking pin 102 enters its slot 60. In addition, the absence of any spring on the rotary member 64 to constrain its rotation can reduce the amount of force needed to lock the cover 36 in prior truck boxes.

Figure 5:
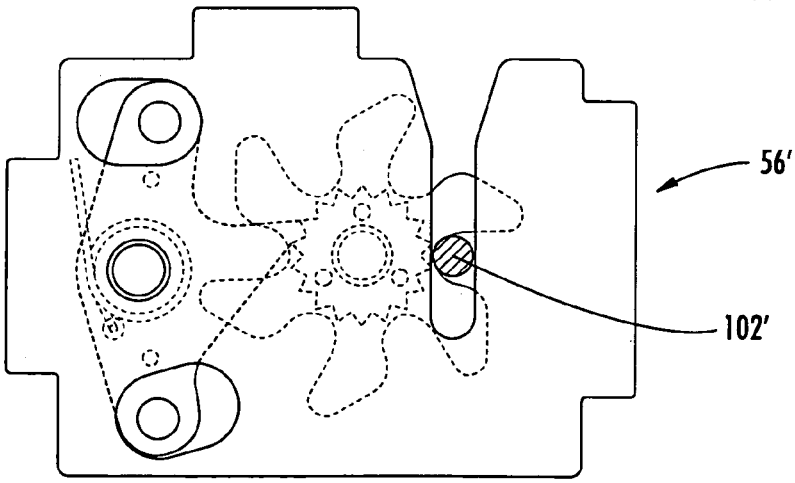
FIG. 5 is a greatly enlarged front view of an alternative embodiment of a rotary unit of the present invention having a smaller locking pin and correspondingly-sized rotary member.

Another advantage of the rotary unit of the present invention is illustrated in FIG. 5, in which an alternative embodiment is illustrated. The rotary unit 56' shown therein is identical to the rotary units 56 illustrated in FIGS. 4 and 4A with the exception that the slot 60' is narrower and the rotary member 64' has narrower gaps 70' to accommodate a thicker locking pin 102. Thus, the manufacturer can provide locking systems of different strength while varying only these components of the locking system.

Figure 10:
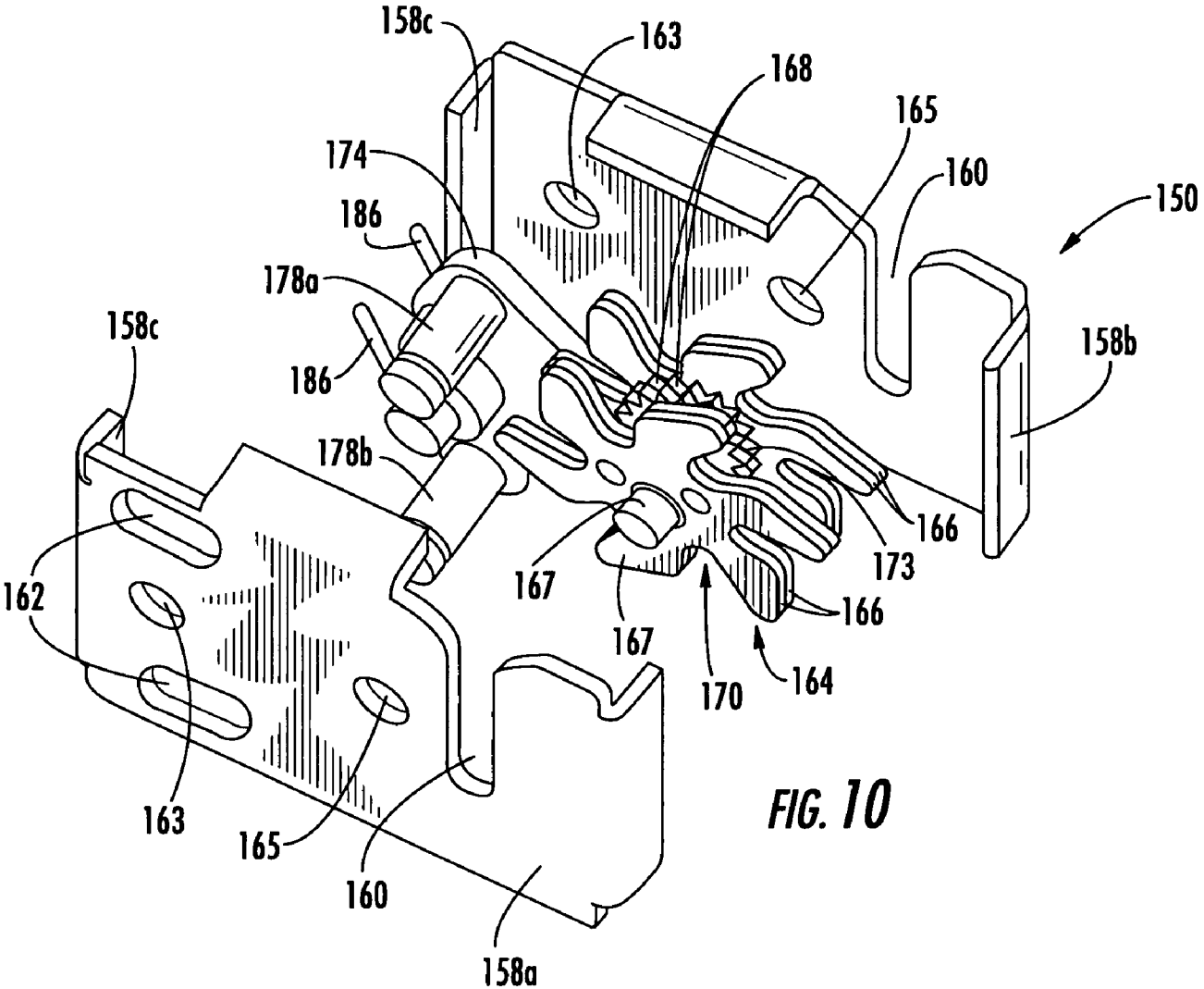
FIG. 10 is a perspective view of a rotary unit according to alternative embodiments of the present invention.
Figure 11:
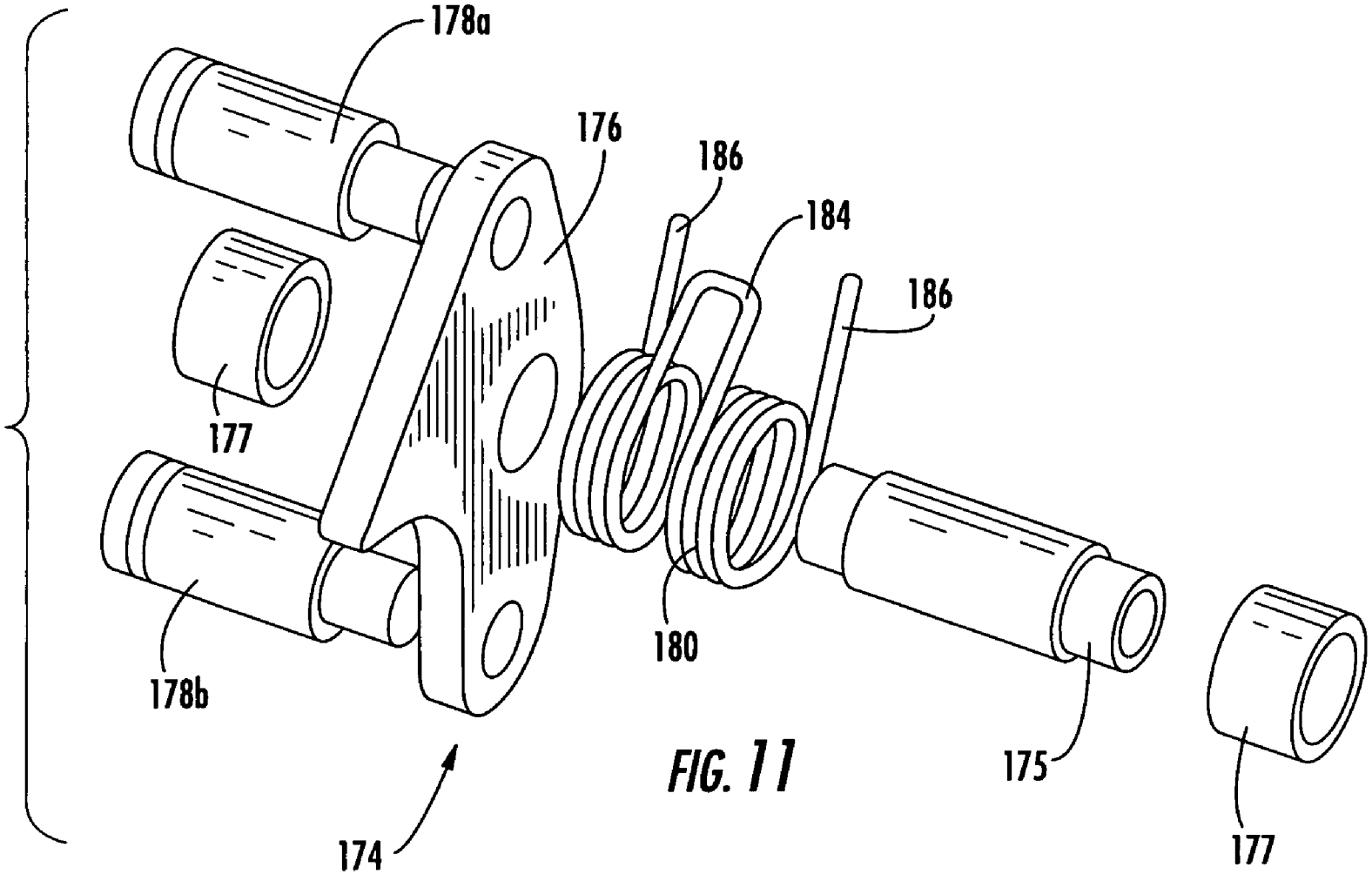
FIG. 11 is an exploded view of the pawl member and components attached thereto of the rotary unit of FIG. 10.
Figure 12:
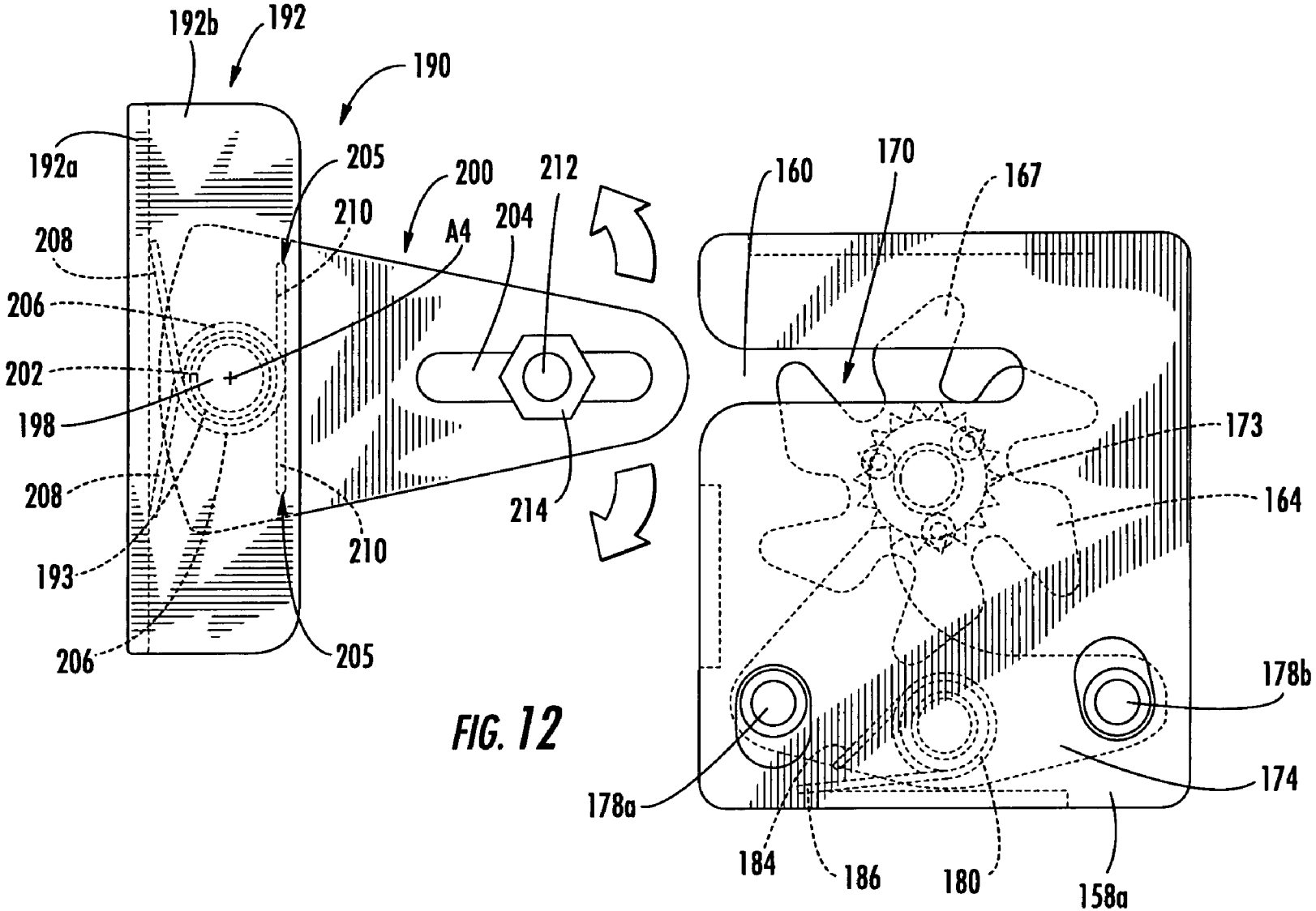
FIG. 12 is a side view of a rotary unit of FIG. 10 and a locking pin assembly according to alternative embodiments of the present invention.

Referring now to FIGS. 10 through 12, an additional embodiment of a rotary unit, designated broadly at 150, is illustrated therein. The rotary unit 150 can be mounted to a container in the manner discussed above, whether it be to a lock console or to some other component of the container, including the cover.

The rotary unit 150 includes two base plates 158*a*, 158*b* that sandwich a rotary member 164 and a pawl member 174. Each of the base plates 158*a*, 158*b* includes a slot 160 that is sized and configured to receive a locking pin of the type illustrated in FIGS. 1-9. The base plate 158*a* also includes two oblong pawl post apertures 162, and both base plates 158*a*, 158*b* include a pawl pivot aperture 163 and a rotary member pivot aperture 165.

The rotary member 164 comprises two sets of outer layers 166 that sandwich a set of inner layers 168. The outer layers 166 are shaped in the pinwheel configuration illustrated for the rotary member 64 of the embodiment of FIGS. 1-9, with fingers 167 and gaps 170, and the inner gear layers 168 are formed into an engagement gear with teeth 173 that resembles gear 72 of the embodiment of FIGS. 1-9. The rotary member 164 is rotatably mounted to the base plates 158*a*, 158*b* via a pin 167 that extends through the apertures 165 in the base plates 158*a*, 158*b*.

Referring in particular to FIG. 11, the pawl member 174 includes a body 176 that is rotatably mounted to the base plates 158*a*, 158*b* via a pivot post 175, which extends through the apertures 163 of the base plates 158*a*, 158*b*. Bushings 177 are positioned on either end of the pivot post 175. The spring 180 includes a loop 184 that fits over the edge of the body 176. Two pawl posts 178*a*, 178*b* extend from the body 176 through the pawl post apertures 162. A spring 180 encircles the pivot post 175. The spring 180 also includes prongs 186 that extend away from the main portion of the spring and rest against the inner surfaces of the end panels 158*c* of the base plates 158*a*, 158*b*.

This embodiment demonstrates how the strength of the lock can be modified. By including or omitting inner or outer layers 168, 166 in the rotary member 164, the strength of the rotary unit 150 can be changed. Also, locating the gear formed by the inner gear layers 168 between the outer layers 166 that form the rotary member 164 can improve the stability and balance thereof. Those skilled in this art will recognize that other configurations for the various components, including those discussed above in connection with the rotary unit 56 of FIGS. 1-9, may also be employed.

Referring now to FIG. 12, an alternative embodiment of a locking pin assembly, designated broadly at 190, is illustrated therein. The locking pin assembly 190 includes a mounting bracket 192 that is configured to be mounted onto the lid of a container, a striker plate 200, and a striker pin 212. The mounting bracket 192 is a C-channel shaped member having two apertures (not shown) in its floor 192*a* and one aperture 193 in each of its side walls 192*b*. The mounting bracket 192 is typically mounted to the underside of the cover of the container via bolts (not shown) that are inserted into the apertures in the floor 192*a* and through apertures in the cover, although the locking pin assembly 190 may be mounted to the receptacle of a container and its corresponding rotary unit mounted to the lid.

Referring still to FIG. 12, the striker plate 200 is generally triangular in shape and extends away from the floor 192*a* of the mounting bracket 192. The striker plate 200 is rotatably mounted to the mounting bracket 192 via a pivot pin 198 that extends through an aperture 202 and through the apertures 193 in the mounting bracket 192. Two springs 206 encircle the pivot pin 198. Each spring has a prong 208 that engages the floor 192*a* of the mounting bracket 192, and also has a finger 210 that inserts through an aperture 205 in the striker plate 200 to engage the striker plate 200. Thus, the striker plate 200 is free to rotate relative to the mounting bracket 192 about an axis of rotation A4 that is generally perpendicular to the slot 160 of the rotary unit 150, but this rotation is muted by the springs 206, each of which urges the striker plate 200 to a rest position similar to that shown in FIG. 12.

The striker pin 212 is mounted to the free end of the striker plate 200. The striker plate 200 includes a slot 204 through which the striker pin 212 extends transversely. The striker pin 212 is secured in position via a nut 214 that is threaded onto the shank of the striker pin 212 and rests against the back side of the striker plate 200.

As is illustrated in FIG. 12, the striker plate 200 is free to rotate about the axis A4, with the rotation being resisted by the springs 206. Thus, as the locking pin assembly 190 approaches a rotary unit 150 such as that shown in FIG. 12, in the event that the striker pin 212 is not precisely aligned with the slot 160 of the rotary unit 150, the ability of the striker plate 200 to rotate about its axis A4 can enable the striker pin 212 to shift position slightly to enter the slot 160.

Figure 13:
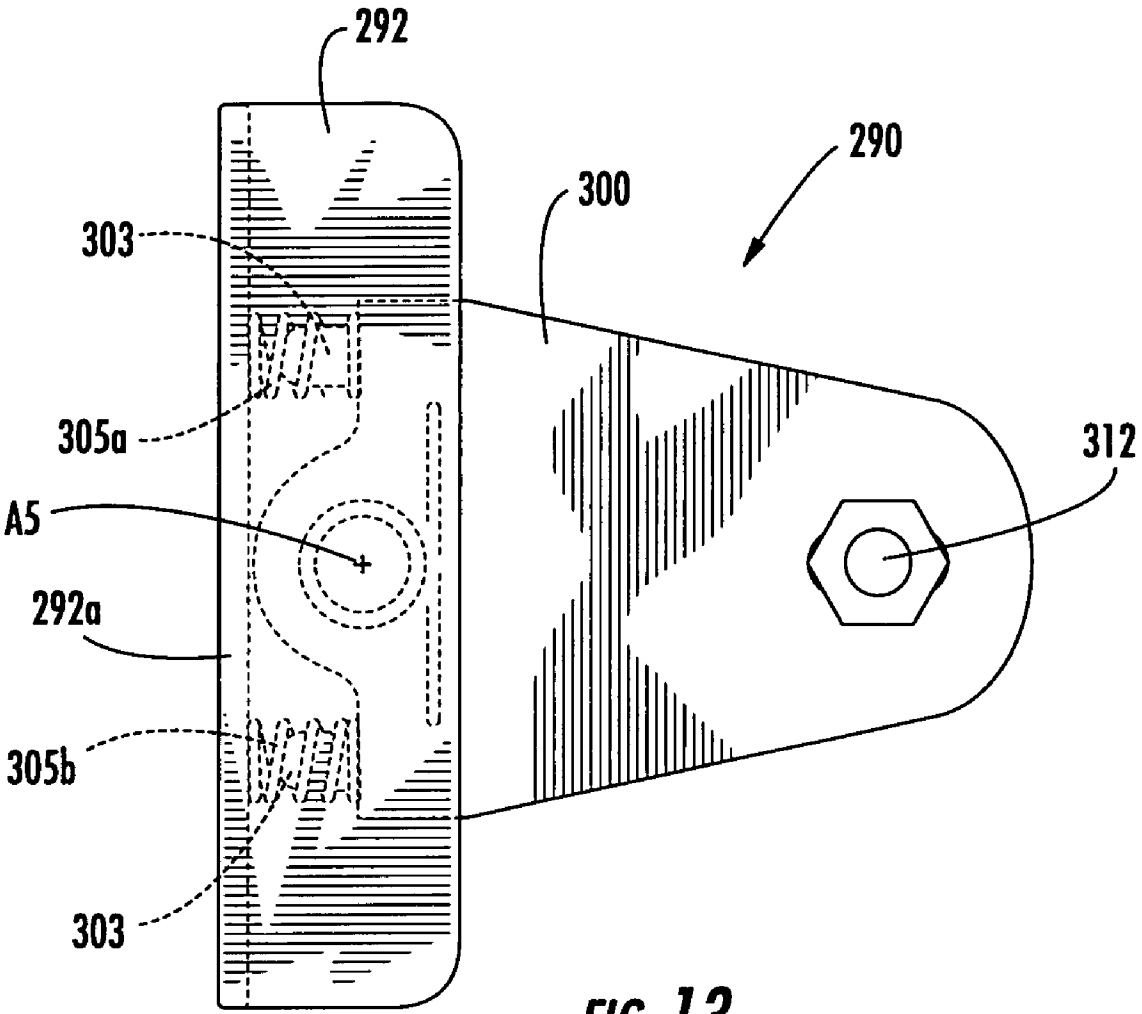
FIG. 13 is a side view of a rotary unit of FIG. 10 and a locking pin assembly according to other embodiments of the present invention.

Another alternative embodiment of a locking post assembly is illustrated in FIG. 13 and designated at 290. In the locking pin assembly 290, the mounting bracket 292, the striker plate 300 and the striker pin 312 are configured similarly to those of the embodiment shown in FIG. 12. However, the striker plate 300 includes two tabs 303 that extend from an edge of the striker plate 300 toward the floor 292*a* of the mounting bracket 292. Two springs 305*a*, 305*b* are attached respective tabs 303. As a result, the striker plate 300 is free to rotate about the axis A5, but is biased against doing so by the springs 305. The rotation of the striker plate 300 enables the striker pin 312 to shift position relative to the slot of a rotary unit.

Figure 14:
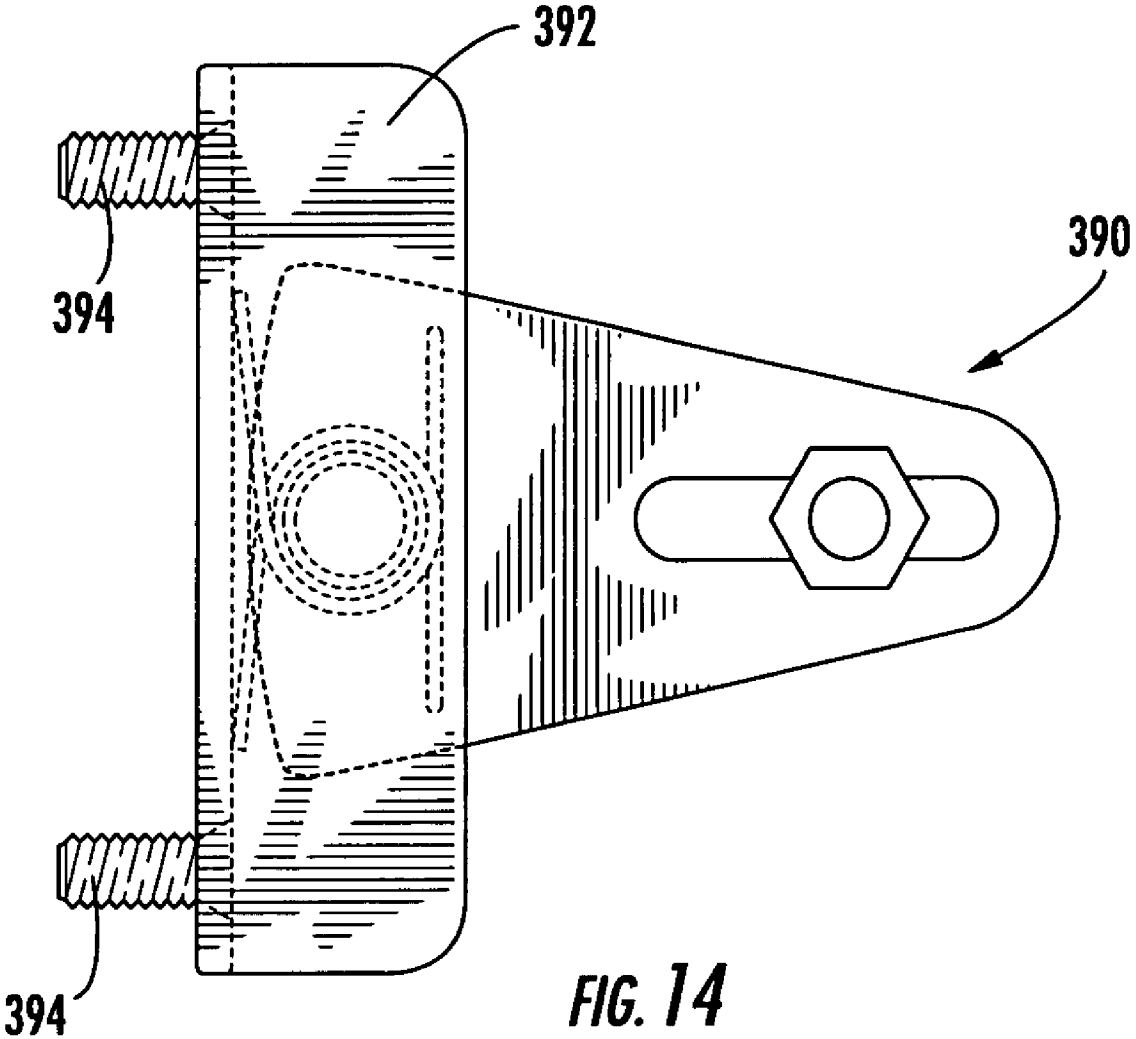
FIG. 14 is a side view of a rotary unit of FIG. 10 and a locking pin assembly according to additional embodiments of the present invention.

An additional embodiment of a locking assembly of the present invention is illustrated in FIG. 14 and designated broadly at 390. The locking assembly 390 is similar to the locking assembly 190 illustrated in FIG. 12, but is mounted to the mounting bracket 392 via fasteners 394. These fasteners have a textured outer surface that enables them to be press-fit and secured into receiving apertures in the cover. Exemplary fasteners includes PINSERT fasteners. The use of such fasteners can reduce assembly time and greatly increase the precision of manufacturing of the container, as the position of the locking assembly 390 relative to the cover can be held to very tight tolerances.

Figure 15:
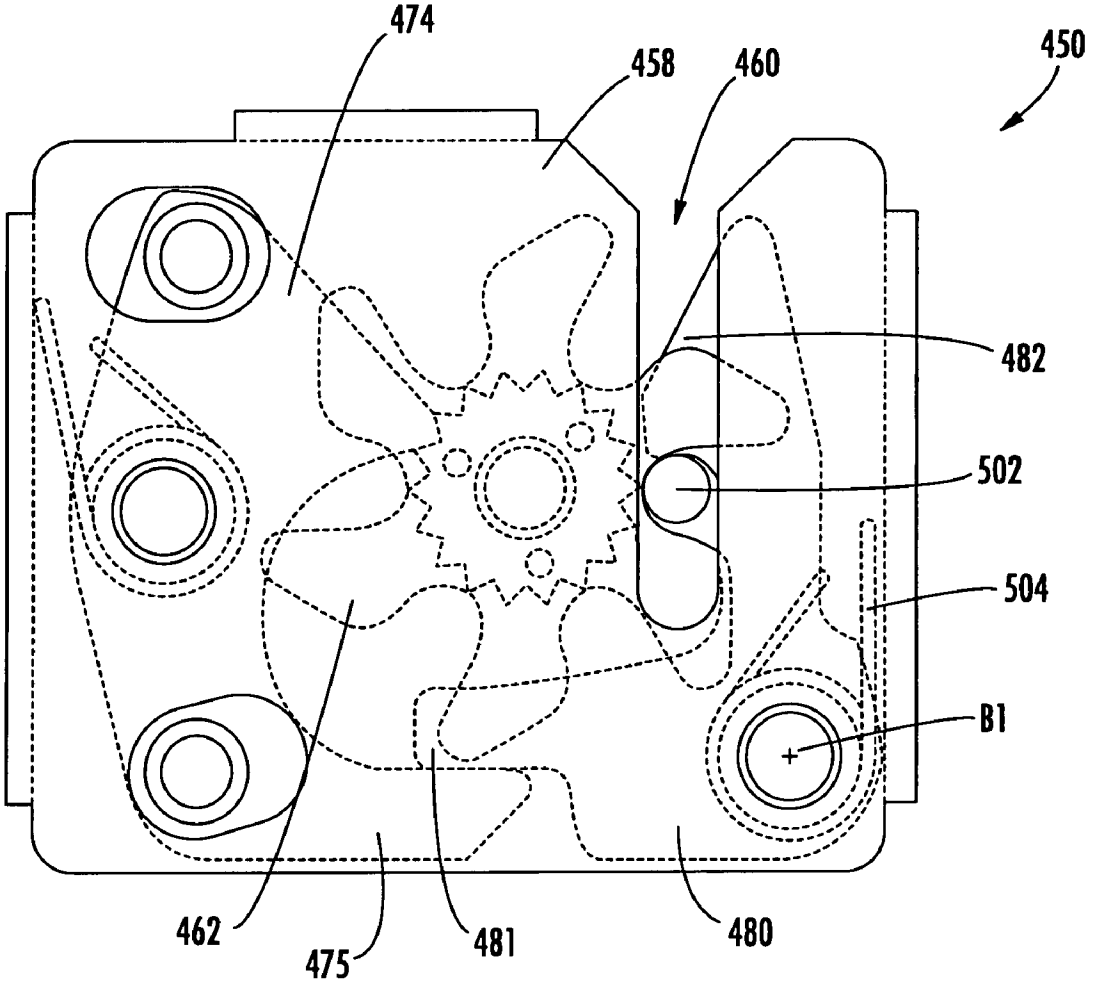
FIG. 15 is a front view of a rotary unit according to alternative embodiments of the present invention.

A further embodiment of a rotary unit of the present invention is illustrated in FIG. 15 and designated broadly at 450. The rotary unit 450 is similar to the rotary unit 56 of FIGS. 1-9, with the exceptions that (a) the pawl member 474 has a foot 475 that extends from the lower end thereof below the rotary member 462, and (b) a retaining member 480 is pivotally attached to the base plates 458 for rotation about an axis B1. The retaining member 480 has a foot 481 that extends toward and engages the upper surface of the foot 475, and also has a finger 482 that extends above the locking pin 502 when the locking pin 502 is engaged by the rotary member 462. The retaining member 482 is biased toward this locking position (i.e., toward the counterclockwise direction as shown in FIG. 15) by a spring 504.

In the locked position shown in FIG. 15, the retaining member 480 assists the rotary member 462 in retaining the locking pin 502 in place by engaging the locking pin 502 with the finger 482. When the locking pin 502 is to be released, the pawl member 474 is rotated by a connecting rod as described above. As the pawl member 474 rotates, the foot 475 of the pawl member 474 moves upwardly and forces the foot 481 of the retaining member 480 upwardly also. This action causes the retaining member to rotate about the axis B1 (clockwise from the vantage point of FIG. 15). This rotation moves the finger 482 away from the slot 460, thereby enabling the locking pin 502 to rise from the slot 460. The presence of the retaining member can strengthen the locking strength of the locking system 450.

The foregoing is illustrative of the present invention, and is not to be construed as limiting thereof. Although exemplary embodiments of this invention have been described, those skilled in the art will readily appreciate that many modifications are possible in the exemplary embodiments without materially departing from the novel teachings and advantages of this invention. As such, all such modifications are intended to be included within the scope of this invention. The scope of the invention is to be defined by the following claims.

That which is claimed is:

1. A container, comprising:

a receptacle having side walls, a floor, and an open end;

a cover pivotally attached to one of the walls of the receptacle, the cover being movable between an open position, in which the open end of the receptacle can be accessed, and a closed position, in which the cover overlies the open end of the receptacle;

a locking pin mounted on one of the cover and a receptacle walls; and at least one locking system for maintaining the cover in the closed position, the locking system comprising:

a release member attached to the other of the cover and a receptacle wall;

a connecting member attached to the release member; and a rotary unit including a base plate having a slot, a rotary member rotatably mounted with the base plate about a first axis of rotation, the rotary member including a plurality of fingers extending radially outwardly from a central portion thereof and an engagement portion fixed to the central portion, the engagement portion being axially offset from the fingers along the first axis of rotation, and a pawl member pivotally mounted with the base plate about a second axis of rotation and coupled with the connecting member;

wherein when the cover is in the closed position, the locking pin is received within the slot of the rotary unit base plate and engages one of the fingers of the rotary member, and the pawl member engages the engagement portion to prevent rotation thereof, and wherein actuation of the release member disengages the pawl member from the engagement portion, thereby enabling the rotary member to rotate freely relative to the base plate, which rotation disengages the locking pin from the rotary member and enables the cover to move to the open position.

2. The container defined in claim 1, wherein the rotary unit includes a biasing member that biases the pawl member to engage the engagement portion of the rotary member.

3. The container defined in claim 1, wherein the container has two side walls, and each of the side walls of the container includes a winged portion that defines a lateral storage region.

4. The container defined in claim 3, wherein a biasing unit that biases the cover toward the open position is mounted in one of the lateral storage regions.

5. The container defined in claim 4, wherein the biasing unit is a gas cylinder.

6. The container defined in claim 1, wherein the position of the locking pin is adjustable relative to the cover.

7. The container defined in claim 6, wherein the position of the locking pin is adjustable along an axis generally parallel to the slot in the rotary unit base plate.

8. The container defined in claim 1, wherein the locking pin is pivotally mounted to the cover about an axis that is generally perpendicular to the slot in the rotary unit base plate.

9. The container defined in claim 8, wherein the locking pin is biased toward a rest position by a biasing member.

10. The container defined in claim 1, wherein the rotary member includes at least four fingers.

11. The container defined in claim 1, wherein the rotary member includes at least six fingers.

12. The container defined in claim 1, wherein the multiple layers include outer layers that form the plurality of fingers and inner layers sandwiched by the outer layers that form the engagement portion.

13. The container defined in claim 1, wherein the release member is a palm button.

14. The container defined in claim 3, wherein the at least one locking system is two locking systems, and further comprising a coupling member that is attached to and extends between the pawl members of the locking systems.

15. The container defined in claim 14, wherein for each locking system, the base plate includes two pawl post apertures, and the pawl member includes two pawl posts, each of which extends through a respective pawl post aperture, and wherein the connecting member of each locking system is coupled to one of the pawl posts of each locking system, and the coupling member extends between the other of the pawl posts of each locking system.

16. The container defined in claim 1, wherein the rotary member fingers are lobed.

17. The container defined in claim 1, wherein the engagement portion of the rotary member is a circular gear with the plurality of teeth positioned around its periphery.

18. The container defined in claim 17, wherein the circular gear includes at least twelve teeth.

19. A rotary unit for use with a locking system, comprising:

a base plate having a slot;

a rotary member rotatably mounted with the base plate about a first axis of rotation, the rotary member including at least six fingers extending radially outwardly from a central portion thereof said fingers configured for engagement with a striker bolt and an engagement portion fixed to the central portion, the engagement portion having a plurality of teeth; and a pawl member pivotally mounted with the base plate about a second axis of rotation and adapted for coupling with a connecting member, the pawl member including an engagement projection that selectively engages the teeth of the engagement portion of the rotary member to prevent rotation of the rotary member in a first rotative direction but permit free rotation of the rotary member in a second rotative direction that is opposite the first rotative direction;

wherein the rotary member is formed of multiple layers that are disposed normal to the first axis of rotation; and wherein the multiple layers include outer layers that form the plurality of fingers and inner layers sandwiched by the outer layers that form the engagement portion.

20. The rotary unit defined in claim 19, further comprising a biasing member that biases the pawl member to engage the engagement portion of the rotary member.

21. The rotary unit defined in claim 19, wherein the rotary member fingers are lobed.

22. The rotary unit defined in claim 19, wherein the engagement portion includes at least twelve teeth.

23. A container, comprising:

a receptacle having walls, a floor, and an open end;

a cover pivotally attached to one of the walls of the receptacle, the cover being movable between an open position, in which the open end of the receptacle can be accessed, and a closed position, in which the cover overlies the open end of the receptacle;

a locking pin assembly fixed to one of the cover and a receptacle wall, the locking pin assembly comprising;

a mounting bracket fixed to the cover;

a striker plate mounted to the mounting bracket and movable relative thereto; and a locking pin attached to the striker plate; and at least one locking system for maintaining the cover in the closed position, the locking system comprising:

a release member attached to the other of the cover and a receptacle wall;

a connecting member attached to the release member; and a rotary unit including a base plate having a slot, a rotary member rotatably mounted with the base plate about a first axis of rotation, the rotary member including at least two fingers and an engagement portion, and a pawl member pivotally mounted with the base plate about a second axis of rotation and coupled with the connecting member;

wherein when the cover is in the closed position, the locking pin is received within the slot of the rotary unit base plate and engages one of the fingers of the rotary member, and the pawl member engages the engagement portion to prevent rotation thereof, and wherein actuation of the release member disengages the pawl member from the engagement portion, thereby enabling the rotary member to rotate relative to the base plate, which rotation disengages the locking pin from the rotary member and enables the cover to move to the open position;

wherein the striker plate is pivotally mounted to the mounting bracket for rotation about a third axis that is generally perpendicular to the slot of the rotary unit base plate.

24. The container defined in claim 23, wherein the locking pin is biased toward a rest position by at least one biasing member.

25. The container defined in claim 24, wherein the at least one biasing member is a helical spring that has a longitudinal axis that is generally parallel with the third axis of rotation.

26. The container defined in claim 24, wherein the at least one biasing member is two helical springs with axes of rotation that are generally parallel to the slot of the rotary base plate.

27. A container, comprising:

a receptacle having side walls, a floor, and an open end;

a cover pivotally attached to one of the walls of the receptacle, the cover being movable between an open position, in which the open end of the receptacle can be accessed, and a closed position, in which the cover overlies the open end of the receptacle;

a locking pin mounted on one of the cover and a receptacle walls; and at least one locking system for maintaining the cover in the closed position, the locking system comprising:

a release member attached to the other of the cover and a receptacle wall;

a connecting member attached to the release member; and a rotary unit including a base plate having a slot, a rotary member rotatably mounted with the base plate about a first axis of rotation, the rotary member including a plurality of fingers extending radially outwardly from a central portion thereof and an engagement portion fixed to the central portion, and a pawl member pivotally mounted with the base plate about a second axis of rotation and coupled with the connecting member;

wherein when the cover is in the closed position, the locking pin is received within the slot of the rotary unit base plate and engages one of the fingers of the rotary member, and the pawl member engages the engagement portion to prevent rotation thereof, and wherein actuation of the release member disengages the pawl member from the engagement portion, thereby enabling the rotary member to rotate freely relative to the base plate, which rotation disengages the locking pin from the rotary member and enables the cover to move to the open position;

wherein the position of the locking pin is adjustable relative to the cover; and wherein the locking pin is mounted to the cover with a mounting bracket having an oblong aperture, and further comprising a generally square slide member that fits within the aperture to which the pin is mounted.

28. A container, comprising:

a receptacle having side walls, a floor, and an open end;

a cover pivotally attached to one of the walls of the receptacle, the cover being movable between an open position, in which the open end of the receptacle can be accessed, and a closed position, in which the cover overlies the open end of the receptacle;

a locking pin mounted on one of the cover and a receptacle walls; and at least one locking system for maintaining the cover in the closed position, the locking system comprising:

a release member attached to the other of the cover and a receptacle wall;

a connecting member attached to the release member; and a rotary unit including a base plate having a slot, a rotary member rotatably mounted with the base plate about a first axis of rotation, the rotary member including a plurality of fingers extending radially outwardly from a central portion thereof and an engagement portion fixed to the central portion, and a pawl member pivotally mounted with the base plate about a second axis of rotation and coupled with the connecting member;

wherein when the cover is in the closed position, the locking pin is received within the slot of the rotary unit base plate and engages one of the fingers of the rotary member, and the pawl member engages the engagement portion to prevent rotation thereof, and wherein actuation of the release member disengages the pawl member from the engagement portion, thereby enabling the rotary member to rotate freely relative to the base plate, which rotation disengages the locking pin from the rotary member and enables the cover to move to the open position;

wherein the container has two side walls, and each of the side walls of the container includes a winged portion that defines a lateral storage region; and wherein the at least one locking system is two locking systems, and further comprising a coupling member that is attached to and extends between the pawl members of the locking systems.

29. A rotary unit for use with a locking system, comprising:

a base plate having a slot;

a rotary member rotatably mounted with the base plate about a first axis of rotation, the rotary member including a plurality of fingers extending radially outwardly from a central portion thereof and an engagement portion fixed to the central portion; and a pawl member pivotally mounted with the base plate about a second axis of rotation and adapted for coupling with a connecting member, the pawl member including an engagement projection that selectively engages the engagement portion of the rotary member to prevent rotation of the rotary member in a first rotative direction but permit free rotation of the rotary member in a second rotative direction that is opposite the first rotative direction;

wherein the base plate includes two pawl post apertures, and the pawl member includes two pawl posts, each of which extends through a respective pawl post aperture.

30. A container, comprising:

a receptacle having side walls, a floor, and an open end;

a cover pivotally attached to one of the walls of the receptacle, the cover being movable between an open position, in which the open end of the receptacle can be accessed, and a closed position, in which the cover overlies the open end of the receptacle;

a locking pin mounted on one of the cover and a receptacle walls; and at least one locking system for maintaining the cover in the closed position, the locking system comprising:

a release member attached to the other of the cover and a receptacle wall;

a connecting member attached to the release member; and a rotary unit including a base plate having a slot, a rotary member rotatably mounted with the base plate about a first axis of rotation, the rotary member including a plurality of fingers extending radially outwardly from a central portion thereof and an engagement portion fixed to the central portion, and a pawl member pivotally mounted with the base plate about a second axis of rotation and coupled with the connecting member;

wherein when the cover is in the closed position, the locking pin is received within the slot of the rotary unit base plate and engages one of the fingers of the rotary member, and the pawl member engages the engagement portion to prevent rotation thereof, and wherein actuation of the release member disengages the pawl member from the engagement portion, thereby enabling the rotary member to rotate freely relative to the base plate, which rotation disengages the locking pin from the rotary member and enables the cover to move to the open position;

wherein the rotary member is formed of multiple layers that are disposed normal to the first axis of rotation.

* * * * *